US011214465B2

(12) United States Patent
Sherrick et al.

(10) Patent No.: US 11,214,465 B2
(45) Date of Patent: Jan. 4, 2022

(54) ELEVATOR SYSTEM SUSPENSION MEMBER

(71) Applicant: Otis Elevator Company, Farmington, CT (US)

(72) Inventors: Kathryn Rauss Sherrick, Bristol, CT (US); Barry G. Blackaby, Simsbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 569 days.

(21) Appl. No.: 15/843,793

(22) Filed: Dec. 15, 2017

(65) Prior Publication Data

US 2018/0170713 A1 Jun. 21, 2018

Related U.S. Application Data

(60) Provisional application No. 62/435,103, filed on Dec. 16, 2016.

(51) Int. Cl.
*B66B 7/06* (2006.01)
*D07B 1/00* (2006.01)
(Continued)

(52) U.S. Cl.
CPC ..... *B66B 7/062* (2013.01); *B66B 9/00* (2013.01); *D07B 1/005* (2013.01); *D07B 1/0686* (2013.01);
(Continued)

(58) Field of Classification Search
CPC .... B66B 7/062; D07B 1/22; D07B 2501/2007
See application file for complete search history.

(56) References Cited

U.S. PATENT DOCUMENTS 4,716,989 A 1/1988 Coleman et al.
7,661,514 B2 2/2010 Ach
(Continued)

FOREIGN PATENT DOCUMENTS

CN 101122100 A 2/2008
CN 201546108 U 8/2010
(Continued)

OTHER PUBLICATIONS

European Search Report Issued in EP Application No. 17207853.7, dated May 15, 2018, 7 Pages.
(Continued)

*Primary Examiner* — Diem M Tran
(74) *Attorney, Agent, or Firm* — Cantor Colburn LLP

(57) ABSTRACT

A belt for suspending and/or driving an elevator system component include one or more metallic cord tension elements extending along a length of the belt, and one or more non-metallic tension elements extending along a length of the belt. Each non-metallic tension element is formed from a non-metallic material. The one or more metallic cord tension elements and the one or more non-metallic tension elements are arrayed laterally across a lateral width of the belt. The belt may be used in an elevator system including a hoistway, a drive machine having a traction sheave coupled thereto, an elevator car movable within the hoistway. The belt is operably connected to the elevator car and interactive with the traction sheave to suspend and/or drive the elevator car along the hoistway.

11 Claims, 4 Drawing Sheets

(51) Int. Cl.

| | |
|---|---|
| ***D07B 1/06*** | (2006.01) |
| ***D07B 1/16*** | (2006.01) |
| ***D07B 1/22*** | (2006.01) |
| ***B66B 9/00*** | (2006.01) |

(52) U.S. Cl.
CPC ..... *D07B 1/162* (2013.01); *D07B 1/22* (2013.01); *D07B 2201/1016* (2013.01); *D07B 2201/1092* (2013.01); *D07B 2201/206* (2013.01); *D07B 2201/2012* (2013.01); *D07B 2201/2082* (2013.01); *D07B 2201/2092* (2013.01); *D07B 2205/3025* (2013.01); *D07B 2401/20* (2013.01); *D07B 2501/2007* (2013.01)

(56) References Cited

U.S. PATENT DOCUMENTS

| | | | | |
|---|---|---|---|---|
| 9,617,118 | B2 * | 4/2017 | Wesson | D03D 15/08 |
| 9,834,409 | B2 * | 12/2017 | Kere | B66B 7/1238 |
| 10,280,039 | B2 | 5/2019 | Pelto-Huikko | |
| 2008/0067010 | A1 | 3/2008 | Ach | |
| 2009/0126296 | A1 * | 5/2009 | Veronesi | B66B 7/062 52/223.1 |
| 2013/0045363 | A1 | 2/2013 | Wesson et al. | |
| 2013/0056305 | A1 | 3/2013 | Sanchez et al. | |
| 2014/0076669 | A1 | 3/2014 | Wesson et al. | |
| 2014/0182976 | A1 | 7/2014 | Valjus et al. | |
| 2016/0016757 | A1 | 1/2016 | Honkanen et al. | |

FOREIGN PATENT DOCUMENTS

| | | | |
|---|---|---|---|
| CN | 202392044 | U | 8/2012 |
| CN | 101343840 | B | 12/2012 |
| CN | 101663222 | B | 1/2013 |
| CN | 102264623 | B | 9/2013 |
| CN | 102304863 | B | 1/2014 |
| CN | 203977213 | U | 12/2014 |
| CN | 204355906 | U | 5/2015 |
| CN | 105672009 | A | 6/2016 |
| EP | 1886960 | B1 | 7/2010 |
| EP | 2154097 | B1 | 9/2011 |
| EP | 2913288 | A1 | 9/2015 |
| WO | 0114630 | A1 | 3/2001 |
| WO | 2009124813 | A1 | 10/2009 |
| WO | 2013041759 | A1 | 3/2013 |
| WO | 2014063900 | A1 | 5/2014 |
| WO | 2015165599 | A1 | 11/2015 |

OTHER PUBLICATIONS

Chinese Office Action for Chinese Application No. 201711360154.1; dated Aug. 19, 2021; Received Sep. 24, 2021.

* cited by examiner

FIG. 2
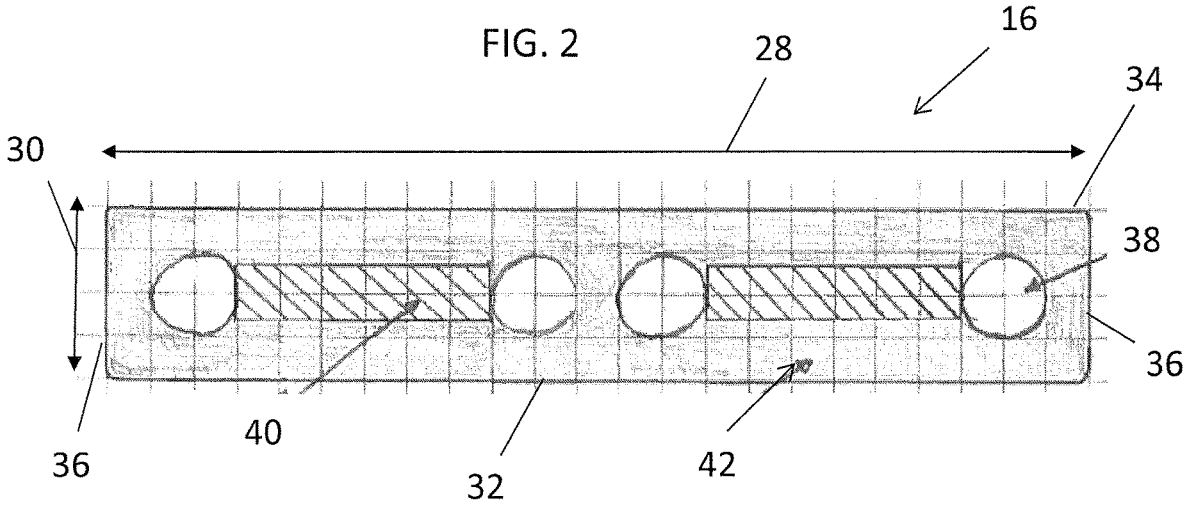
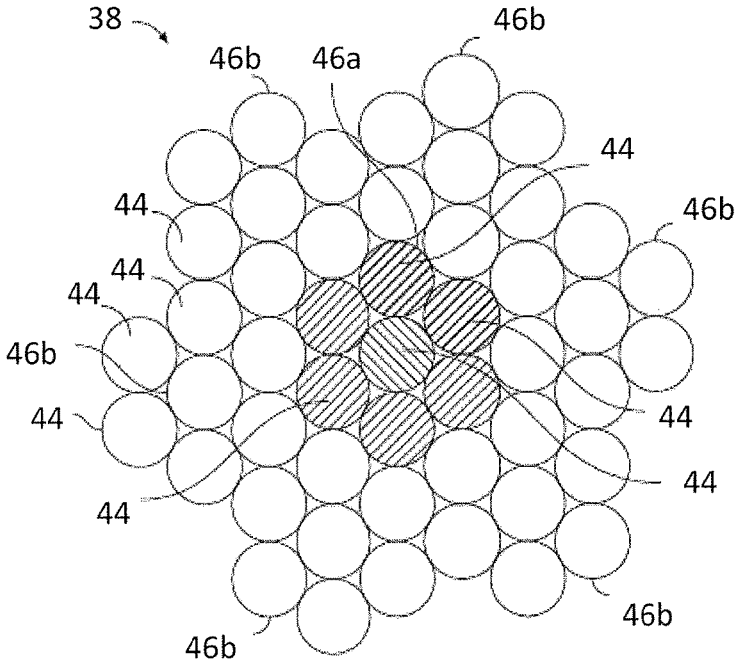
FIG. 3

ELEVATOR SYSTEM SUSPENSION MEMBER

CROSS-REFERENCE TO RELATED APPLICATIONS

This application claims the benefit of 62/435,103, filed Dec. 16, 2016, which is incorporated herein by reference in its entirety.

BACKGROUND

The subject matter disclosed herein relates to elevator systems. More particularly, the present disclosure relates to suspension members of elevator systems.

A typical elevator system includes an elevator car, suspended by one or more suspension members, typically a rope or belt, that moves along a hoistway. The suspension member includes one or more tension members and is routed over one or more sheaves, with one sheave, also known as a drive sheave, operably connected to a machine. The machine drives movement of the elevator car via interaction of the drive sheave with the suspension member. The elevator system further typically includes a counterweight interactive with the suspension member. One or more of the ends of the suspension member are terminated, or retained in the hoistway.

As buildings reach new heights in their construction, with some architectural designs over 1 kilometer, more advanced hoisting methods are necessary for efficiently transport of people and materials throughout the building. One limitation of conventional hoisting is the weight of conventional steel cable as it is only capable of rises of ~700 m. To address this, tension members have been developed using lightweight tension elements, such as those formed from carbon fiber, as these have a substantially higher specific strength and will allow hoisting solutions that can accommodate the proposed architectural designs of over 1 kilometer and there is substantial advantage of using lightweight tension members in buildings of even rises down to ~300 m.

BRIEF DESCRIPTION

In one embodiment, a belt for suspending and/or driving an elevator system component include one or more metallic cord tension elements extending along a length of the belt, and one or more non-metallic tension elements extending along a length of the belt. Each non-metallic tension element is formed from a non-metallic material. The one or more metallic cord tension elements and the one or more non-metallic tension elements are arrayed laterally across a lateral width of the belt.

Additionally or alternatively, in this or other embodiments a laterally outboardmost metallic cord tension element of the one or more metallic cord tension elements is located laterally outboard of the laterally outboardmost non-metallic tension element of the one or more non-metallic tension elements.

Additionally or alternatively, in this or other embodiments a non-metallic tension element of the one or more non-metallic tension elements is located laterally between two metallic cord tension elements of the one or more metallic cord tension elements.

Additionally or alternatively, in this or other embodiments the belt includes a jacket, wherein the one or more metallic cord tension elements and the one or more non-metallic tension elements are at least partially encased in the jacket.

Additionally or alternatively, in this or other embodiments the jacket is formed from a polymer material.

Additionally or alternatively, in this or other embodiments each metallic cord tension element of the one or more metallic cord tension elements has a greater effective cross-sectional diameter than each non-metallic tension element of the one or more non-metallic tension elements.

Additionally or alternatively, in this or other embodiments each non-metallic tension element includes a plurality of fibers extending along a length of the non-metallic tension element and a polymer matrix into which the plurality of fibers are bonded.

Additionally or alternatively, in this or other embodiments the plurality of fibers are formed from one or more of carbon, glass, polyester, nylon, or aramid material.

Additionally or alternatively, in this or other embodiments each metallic cord tension element is formed from a plurality of steel wires arranged into a cord.

In another embodiment an elevator system includes a hoistway, a drive machine having a traction sheave coupled thereto, an elevator car movable within the hoistway, and at least one belt operably connected to the elevator car and interactive with the traction sheave to suspend and/or drive the elevator car along the hoistway. The belt includes one or more metallic cord tension elements extending along a length of the belt, each metallic cord tension element including a plurality of steel wires arranged into a cord and one or more non-metallic tension elements extending along a length of the belt, each non-metallic tension element formed from a non-metallic material. The one or more metallic cord tension elements and the one or more non-metallic tension elements are arrayed laterally across a lateral width of the belt.

Additionally or alternatively, in this or other embodiments a laterally outboardmost metallic cord tension element of the one or more metallic cord tension elements is located laterally outboard of the laterally outboardmost non-metallic tension element of the one or more non-metallic tension elements.

Additionally or alternatively, in this or other embodiments a non-metallic tension element of the one or more non-metallic tension elements is located laterally between two metallic cord tension elements of the one or more metallic cord tension elements.

Additionally or alternatively, in this or other embodiments the belt includes a jacket, wherein the one or more metallic cord tension elements and the one or more non-metallic tension elements are at least partially encased in the jacket.

Additionally or alternatively, in this or other embodiments the jacket is formed from a polymer material.

Additionally or alternatively, in this or other embodiments each metallic cord tension element of the one or more metallic cord tension elements has a greater effective cross-sectional diameter than each non-metallic tension element of the one or more non-metallic tension elements.

Additionally or alternatively, in this or other embodiments each non-metallic tension element includes a plurality of fibers extending along a length of the non-metallic tension element and a polymer matrix into which the plurality of fibers are bonded.

Additionally or alternatively, in this or other embodiments the plurality of fibers are formed from one or more of carbon, glass, polyester, nylon, or aramid material.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

FIG. 2 is a cross-sectional view of an embodiment of a belt for an elevator system;

FIG. 3 illustrates an embodiment of a cord tension element for a belt of an elevator system;

DETAILED DESCRIPTION

Figure 1:
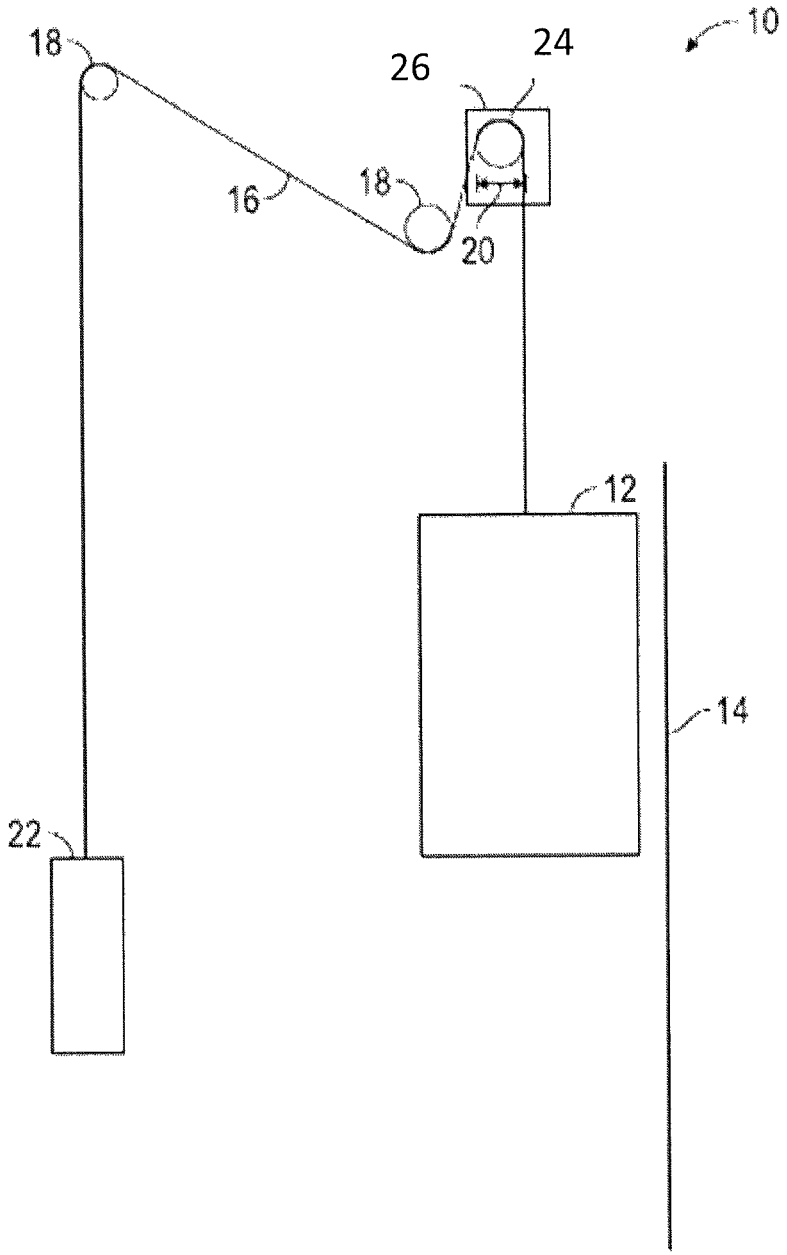
FIG. 1 is a schematic view of an exemplary elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of drive sheave by the machine 26 drives, moves and/or propels (through traction) the one or more belts 16 that are routed around the traction sheave 24. At least one of the sheaves 18 could be a diverter, deflector or idler sheave. Diverter, deflector or idler sheaves are not driven by a machine 26, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 12 and counterweight 22, while other embodiments may utilize other roping arrangements.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

FIG. 2 provides a cross-sectional schematic of an exemplary belt 16 construction or design. The belt 16 has a belt width 28 and a belt thickness 30 with an aspect ratio of belt width 28 to belt thickness 30 greater than one. The belt 16 defines a traction side 32, which is interactive with the traction sheave 24 and a back side 34 opposite the traction side 32. The belt 16 further defines belt edges 36 extending between the traction side 32 and the back side 34.

The belt 16 includes a plurality of tension elements extending longitudinally along the belt 16. In this hybrid belt construction, the belt 16 includes both one or more metallic cord tension elements 38 and one or more non-metallic—tension elements 40. In some embodiments, as shown in FIG. 3, the metallic cord tension elements 38 are formed from a plurality of steel wires 44, which may be arranged into strands 46, and grouped to form the metallic cord tension element 38. In some embodiments, the metallic cord tension element 38 includes a center strand **46*a* and a number of outer strands 46*b* located around the center strand 46*a*. In some embodiments all of strands 46*a*, 46*b* are identical, while in other embodiments, the center strand 46*a* has a construction or configuration that differs from the outer strands 46*b*. Further, in some embodiments, the metallic cord tension elements 38 are identically configured, while in other embodiments the metallic cord tension elements 38 may differ in configuration based on, for example, a lateral position of the cord tension element 38 in the belt 16**.

Figure 4:
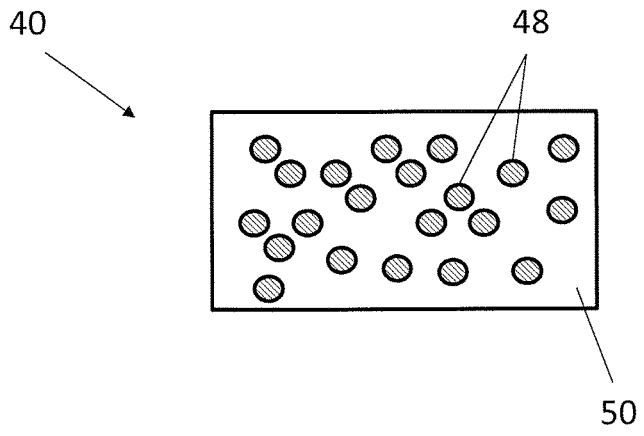
FIG. 4 illustrates an embodiment of a fiber tension element for a belt of an elevator system.

Referring now to FIG. 4, an embodiment of a non-metallic tension element 40 is illustrated. In some embodiments, the non-metallic tension element 40 includes a plurality of fibers 48, for example, carbon fibers, bonded to a polymer matrix 50 to form the non-metallic tension element 40. The fibers 48 are continuous or discontinuous or combination of continuous and discontinuous over the belt 16 length, and oriented generally such that a fiber 48 length is directed along the belt 16 length. The fibers 48 may be formed of one or more of a number of materials, such as carbon, glass, polyester, nylon, aramid or other polyimide materials. Further, the fibers 48 may be organized into a grouping, such as a spun yarn. The polymer matrix 50 may be formed of, for example a thermoset or thermoplastic material. The non-metallic tension element 40 may further be configured to have a fiber 48 density of 30% to 70% fibers 48 per unit of volume. In some embodiments, the fibers 48 may vary in size, length or circumference and may further be intentionally varied to provide a selected maximum fiber 48 density. While the non-metallic tension elements 40 in the embodiment of FIG. 4 are rectangular in cross-section, it is to be appreciated that other cross-sectional shapes, such as circular, may be utilized in other embodiments. Further, while carbon fibers are utilized in some embodiments, one skilled in the art will readily appreciate that other types of fibers or yarns or the like or constructions without fibers 48 may be utilized to form non-metallic tension element 40.

In some embodiments, the tension elements are grouped, with a non-metallic tension element 40 positioned laterally between two metallic cord tension elements 38. Further, as shown in FIG. 2, the metallic cord tension elements 38 may have a greater effective diameter that the non-metallic tension elements 40. Further, in some embodiments, a bending stiffness of the metallic cord tension element 38 is similar to a bending stiffness of the non-metallic tension element 40. In some embodiments, the bending stiffnesses are within +/−5% of each other. The metallic cord tension elements 38 and the non-metallic tension elements 40 are at least partially encased in a jacket 42. The jacket 42 may define one or more of the traction side 32, the back side 34, and/or the belt edges 36. In some embodiments, the jacket 42 is formed from a polymer material such as a thermoplastic polyurethane (TPU). It is to be appreciated that in other embodiments other materials may be utilized in jacket 42.

Figure 5:
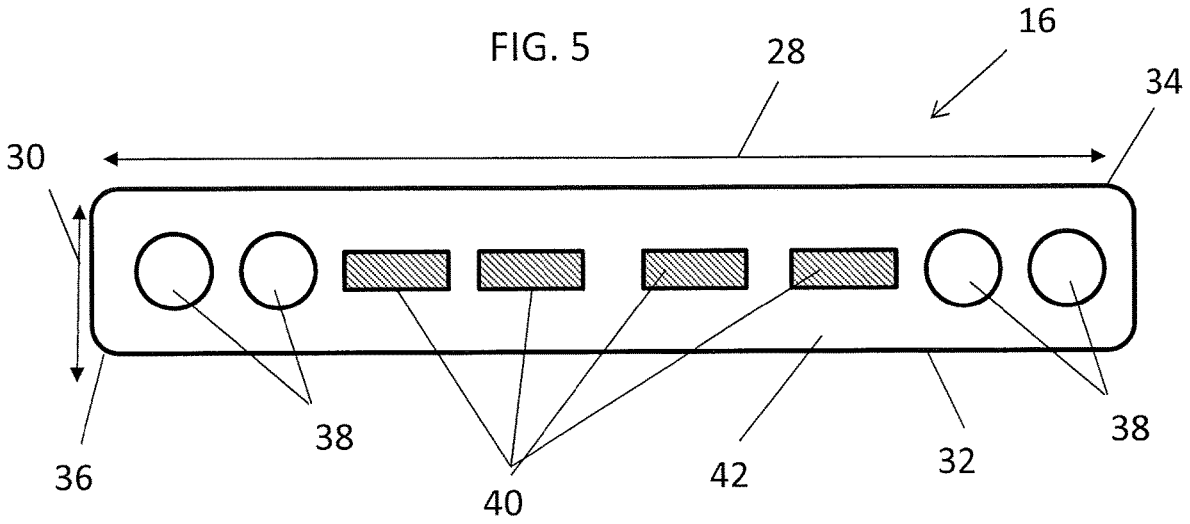
FIG. 5 is a cross-sectional view of an embodiment of a belt for an elevator system.

In other embodiments, other arrangements of metallic cord tension elements 38 and non-metallic tension elements 40 may be utilized. One such embodiment is illustrated in FIG. 5. In the embodiment of FIG. 5, the belt 16 includes four non-metallic tension elements 40 located at a lateral center of the belt 16 bounded by metallic cord tension elements 38 located laterally outboard of the non-metallic tension elements 40. In the embodiment shown in FIG. 5, two metallic cord tension elements 38 are located at each lateral side of the non-metallic tension elements 40, but one skilled in the art will readily appreciate that other quantities of metallic cord tension elements 38 and non-metallic tension elements 40 may be utilized. In some embodiments, it is preferable for metallic cord tension elements 38 to be located laterally outboard of the non-metallic tension elements 40.

Utilizing a combination of metallic cord tension elements 38 and non-metallic fiber tension elements 40 provides a belt 16 that is lighter per unit length than a traditional coated steel belt, while maintaining high braking load requirements of the belt 16. The lighter belt 16 significantly reduces sheave load and machine loads, thus allowing smaller machines for higher lift elevator systems 10. Further, the belt 16 improves performance in the event of jacket failure or extreme jacket abrasion, when compared to a belt having only fiber tension elements.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A belt for suspending and/or driving an elevator system component, comprising:

two or more metallic cord tension elements extending along a length of the belt;

two or more non-metallic tension elements extending along a length of the belt, each non-metallic tension element formed from a non-metallic material; and a jacket, wherein the two or more metallic cord tension elements and the two or more non-metallic tension elements are at least partially encased in the jacket;

wherein the two or more metallic cord tension elements and the two or more non-metallic tension elements are arrayed laterally across a lateral width of the belt;

wherein the two or more non-metallic tension elements include a plurality of fibers extending along a length of the non-metallic tension element bonded to a polymer matrix;

wherein the two or more metallic cord tension elements and the two or more non-metallic tension elements are arranged in two or more groups arranged laterally across a width of the belt, each group including:

two metallic cord tension elements of the two or more metallic cord tension elements; and one non-metallic tension element of the two or more non-metallic tension elements disposed between the two metallic cord tension elements;

wherein a portion of the jacket is disposed between laterally adjacent groups of the two or more groups;

wherein a first metallic cord tension element of a first group of the two or more groups is adjacent at a first side to the non-metallic tension element of the first group and laterally adjacent at a second side to a second metallic cord tension element of a second group of the two or more groups.

2. The belt of claim 1, wherein a laterally outboardmost metallic cord tension element of the two or more metallic cord tension elements is located laterally outboard of the laterally outboardmost non-metallic tension element of the two or more non-metallic tension elements.

3. The belt of claim 1, wherein the jacket is formed from a polymer material.

4. The belt of claim 1, wherein each metallic cord tension element of the two or more metallic cord tension elements has a greater cord width in a belt thickness direction than each non-metallic tension element width in the belt thickness direction of the two or more non-metallic tension elements.

5. The belt of claim 1, wherein the plurality of fibers are formed from one or more of carbon, glass, polyester, nylon, or aramid material.

6. The belt of claim 1, wherein each metallic cord tension element is formed from a plurality of steel wires arranged into a cord.

7. An elevator system, comprising:

a hoistway;

a drive machine having a traction sheave coupled thereto;

an elevator car movable within the hoistway; and a belt operably connected to the elevator car and interactive with the traction sheave to suspend and/or drive the elevator car along the hoistway, the belt including:

two or more metallic cord tension elements extending along a length of the belt, each metallic cord tension element including a plurality of steel wires arranged into a cord;

two or more non-metallic tension elements extending along a length of the belt, each non-metallic tension element formed from a non-metallic material; and a jacket, wherein the two or more metallic cord tension elements and the two or more non-metallic tension elements are at least partially encased in the jacket;

wherein the two or more metallic cord tension elements and the two or more non-metallic tension elements are arrayed laterally across a lateral width of the belt;

wherein the two or more non-metallic tension elements include a plurality of fibers extending along a length of the non-metallic tension element bonded to a polymer matrix;

wherein the two or more metallic cord tension elements and the two or more non-metallic tension elements are arranged in two or more groups arranged laterally across a width of the belt, each group including:

two metallic cord tension elements of the two or more metallic cord tension elements; and one non-metallic tension element of the two or more non-metallic tension elements disposed between the two metallic cord tension elements;

wherein a portion of the jacket is disposed between laterally adjacent groups of the two or more groups;

wherein a first metallic cord tension element of a first group of the two or more groups is laterally adjacent at a first side to the non-metallic tension element of the first group and laterally adjacent at a second side to a second metallic cord tension element of a second group of the two or more groups.

8. The elevator system of claim 7, wherein a laterally outboardmost metallic cord tension element of the two or more metallic cord tension elements is located laterally outboard of the laterally outboardmost non-metallic tension element of the two or more non-metallic tension elements.

9. The elevator system of claim 7, wherein the jacket is formed from a polymer material.

10. The elevator system of claim 7, wherein each metallic cord tension element of the two or more metallic cord tension elements has a greater cord width in a belt thickness direction than each non-metallic tension element width in the belt thickness direction of the two or more non-metallic tension elements.

11. The elevator system of claim 7, wherein the plurality of fibers are formed from one or more of carbon, glass, polyester, nylon, or aramid material.

* * * * *